US005084707A

United States Patent [19]

Reits

[11] Patent Number: 5,084,707

[45] Date of Patent: Jan. 28, 1992

[54] ANTENNA SYSTEM WITH ADJUSTABLE BEAM WIDTH AND BEAM ORIENTATION

[75] Inventor: Bernard J. Reits, Hengelo, Netherlands

[73] Assignee: Hollandse Signaalapparaten B.V., Hengelo, Netherlands

[21] Appl. No.: 653,593

[22] Filed: Feb. 8, 1991

[51] Int. Cl.[5] ..... H01Q 3/00

[52] U.S. Cl. ..... 342/376; 343/754

[58] Field of Search ..... 342/368, 376, 372, 373, 342/54; 343/754

[56] References Cited

U.S. PATENT DOCUMENTS

| | | | |
|---|---|---|---|
| 3,979,750 | 9/1976 | Smith | 343/754 |
| 4,896,033 | 1/1990 | Gautier | 343/754 |
| 4,929,956 | 5/1990 | Lee et al. | 342/376 |

*Primary Examiner*—Mark Hellner
*Attorney, Agent, or Firm*—Robert J. Kraus

[57] ABSTRACT

An antenna system provided with an adjustable reflection coefficient includes at least one radiation source (1), a reflective surface (12) positioned in the path of the radiation generated by the active radiation source (1) and 9 light-generating means (13, 14). The reflective surface (12) is provided with semiconductor surfaces (2.i.j) with a spacer-therebetween and the light of the light-generating means (13, 14) is used to illuminate the semiconductor surfaces (2.i.j) such that, after reflection of the radiation generated by the active radiation source at the reflecting semiconductor surfaces, a radiation beam is obtained in which the beam width and beam orientation can be varied by adjusting the light intensity so as to adjust the phase of the reflection of the semiconductor surfaces.

21 Claims, 8 Drawing Sheets

ANTENNA SYSTEM WITH ADJUSTABLE BEAM WIDTH AND BEAM ORIENTATION

BACKGROUND OF THE INVENTION

The invention relates to an antenna system provided with at least one active radiation source and a reflective surface which is positioned in at least a part of the path of the radiation generated by the active radiation source.

The invention particularly relates to the reflector surface of an antenna system with adjustable beam parameters, such as beam width and beam orientation.

Such an antenna system with adjustable beam width and beam orientation is known from U.S. Pat. No. 3,978,484. The reflector surface of this antenna system is formed by a substantial number of subreflectors, each of which reflects a part of the radiation generated by the source of radiation, with a phase which is selected such that a radiation beam is obtained having the required orientation and beam width. Phase shift is obtained by a transducer-adjustable plate in a wave guide. The drawback of this system is that if a beam is to be adjusted with different parameters, much time is lost because this adjustment is performed using mechanical means. The invention is aimed at obviating this drawback.

SUMMARY OF THE INVENTION

The invention is characterised in that the reflective surface is provided with semiconductor surfaces and the antenna system is provided with light-generating means, which light is used to illuminate the semiconductor surfaces such that, after reflection of the radiation generated by the active radiation source at the reflecting semiconductor surfaces, at least one radiation beam is obtained.

Besides the advantage that the beam parameters can be adjusted in a very short timespan, the invention furthermore offers the possibility to develop antenna systems with adjustable beam width and beam orientation for wavelengths so short that hitherto this was deemed impossible.

BRIEF DESCRIPTION OF THE DRAWINGS

The invention will now be described in more detail with reference to the following figures, of which.

DESCRIPTION OF THE PREFERRED EMBODIMENTS

Figure 1:
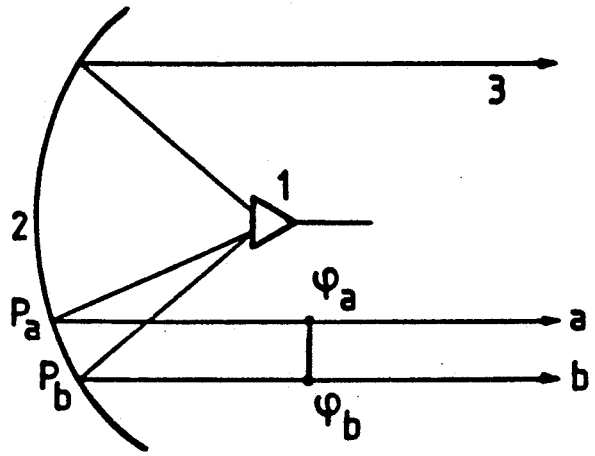
FIG. 1 represents a schematic diagram of a conventional antenna system with a reflective surface having a parabolic contour.

FIG. 1 shows a feedhorn 1 in a cross-section of a simple conventional antenna sytem. The feedhorn 1 is positioned opposite a reflective surface 2 and generates electromagnetic waves having a wavelength $\lambda$ in the direction of the surface 2. In case of radar applications, a receive horn may also be incorporated for the reception of echo signals reflected by an object. The reflective surface is contoured such that after reflection on the surface 2, a virtually parallel or slightly diverging beam 3 is obtained.

To this end, the surface may have a substantially parabolic contour, the feedhorn being positioned in the focal plane, preferably near the focal point of the contour.

After reflection, the phase difference $\Delta\phi=\phi_a-\phi_b$ between emerging beams a and b in the indicated direction is exactly $\Delta\phi=0°$ as a result of which these beams amplify each other in this direction. It will be obvious that a similar beam is obtained when the phase difference is $\Delta\phi=\phi_a-\phi_b=\pm k\times 360°$ ($k=1, 2, \ldots$). This means that the reflection points $\phi_a$ and $\phi_b$ over a distance of $\pm k\times\frac{1}{2}\lambda$ ($k=1, 2, \ldots$) in the direction of the incident beam can be shifted with respect to each other without affecting the reflective characteristics of the reflective surface.

This principle has been applied in the cited U.S. patent where the electromagnetic waves reflect on a 2-dimensional array of mechanical phase shifters positioned in waveguides such that a phase shift is effected in the transmitted beam, which phase shift is virtually equal to the phase shift in the transmitted beam as represented in FIG. 1.

Figure 2:
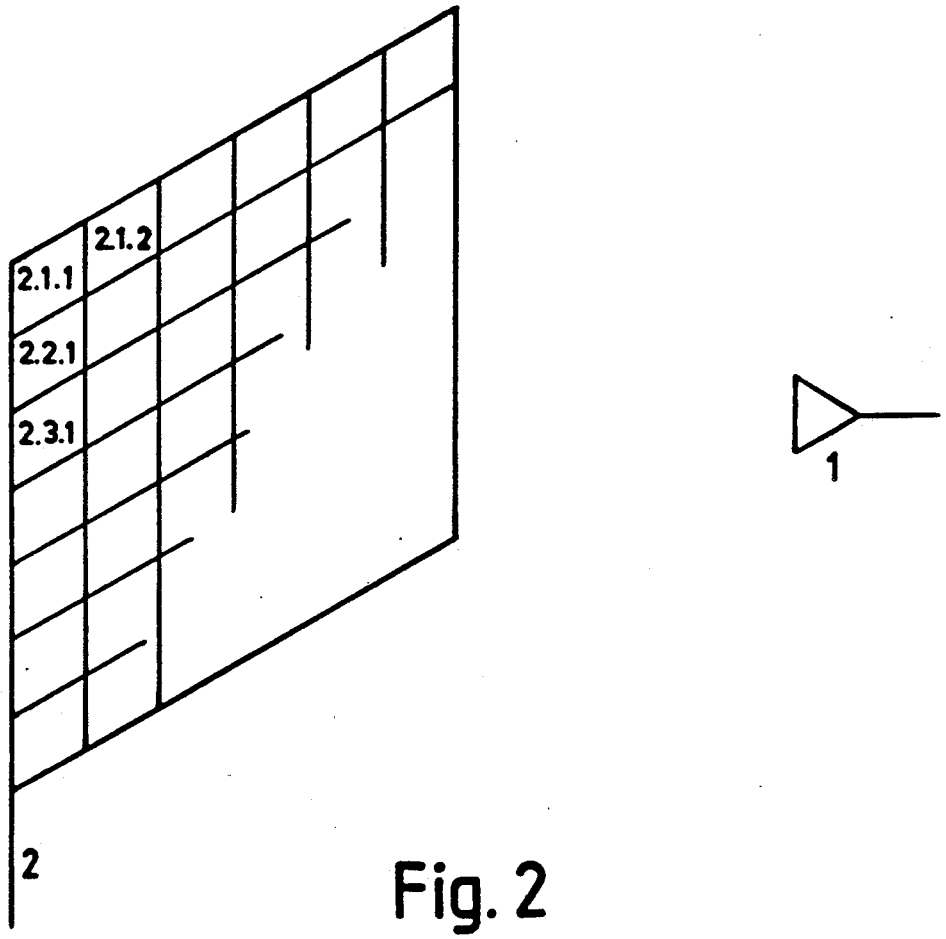
FIG. 2 represents a schematic diagram of an antenna system with a reflective surface provided with semiconductor surfaces.

A simple embodiment of the invention is illustrated in FIG. 2, in which the feedhorn is indicated by reference number 1. The reflective surface, indicated by reference number 2, consists of a 2-dimensional array of semiconductor surfaces 2.i.j ($i=1, 2, \ldots, N$; $j=1, 2, \ldots, M$). The numbers N and M depend on the application and will increase as the required minimal beam width of the antenna system decreases in the vertical and horizontal direction, respectively. As will be explained further, the semiconductor surfaces can reflect electromagnetic waves, the reflections having a phase which can be adjusted with the aid of light-generating means, such that a phase shift in the transmitted beam is obtained which is substantially equal to the phase shift in the transmitted beam as represented in FIG. 1.

Analogous to the cited U.S. patent, a beam with selected beam parameters, viz. beam width and beam orientation, can be obtained by adjusting the phase of the reflection of the individual semiconductor surfaces 2.i.j ($i=1, 2, \ldots, N$; $j=1, 2, \ldots, M$).

As indicated in FIG. 2, the semiconductor surfaces can be positioned substantially contiguously. It is also possible however to fit each semiconductor surface in a separate waveguide, after which the invention, at least as regards outward appearance, resembles the invention described in the cited U.S. patent.

Figure 3:
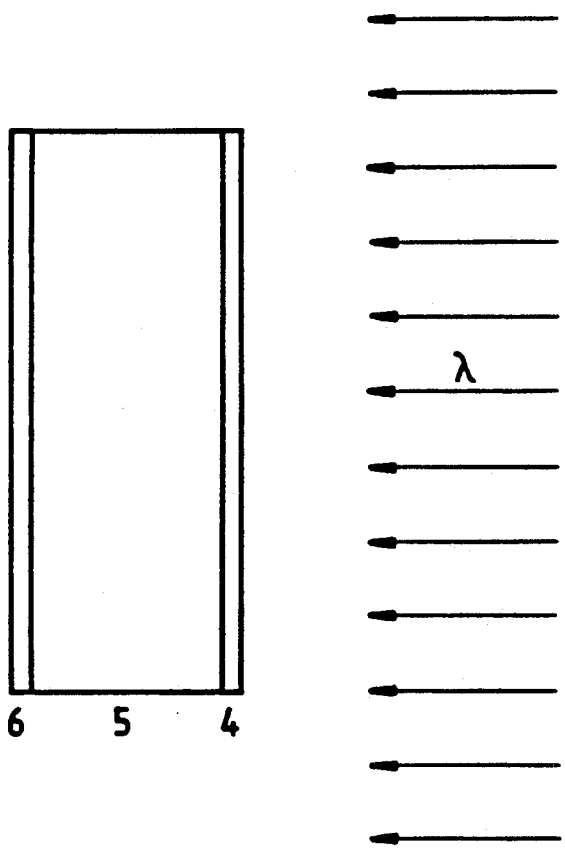
FIG. 3 represents a cross-section of a semiconductor surface.

FIG. 3 represents the cross-section of a semiconductor surface 2.i.j., consisting of a spacer 5, a thin layer of semiconducting material applied to the front surface 4, and a thin layer of semiconducting material applied to the back surface 6. The layers of semiconducting material are for instance 100 μm thick and may be deposited on a substrate material, such as glass. The spacer 5 is made of a material having a relative dielectric constant of just about one, such as synthetic foam. The length of the spacer is $\lambda/4+k.\lambda/2$, $k=0, 1, 2, \ldots$ If such a semiconductor surface is exposed to a radiation of wavelength λ, generated by the radiation source, at approximately right angles to the propagation direction of the radiation, then especially the two layers of semiconducting material, which as a rule have a large dielectric constant, will reflect a part of the radiation. Owing to the well-chosen distance between these two layers, both reflections will substantially cancel each other.

If the front surface 4 is now irradiated with photons which are capable of releasing electrons in the semiconducting material, then an additional reflection is created in the front surface 4. Particularly if the light has a wavelength such that one photon can at least generate one free electron, substantially all of the light is absorbed by a 100 μm thick layer of semiconducting material and is entirely converted into free electrons. As a result, the semiconducting material will become conducting and will exhibit additional reflection for the radiation generated by the radiation source. More particularly, significant reflection will occur if $$\sigma > \frac{2\pi c\epsilon}{\lambda}$$

where $\sigma$ is the conductivity of the semiconducting material, c is the speed of light, $\epsilon$ the dielectric constant of the semiconducting material and λ the wavelength of the incident electromagnetic radiation. By selecting a suitable light intensity and thus a suitable conductivity, a significant reflection will be achieved for the radiation generated by the radiation source, whereas for the light whose wavelength is smaller by several orders of magnitude, practically no change in reflection will occur.

Similarly, an adjustable reflection at the back surface 6 can be created by illuminating the back surface. If the reflection at the front surface 4 is projected in the complex plane along the positive real axis, the reflection at the back surface 6 will be projected along the negative real axis.

Figure 4:
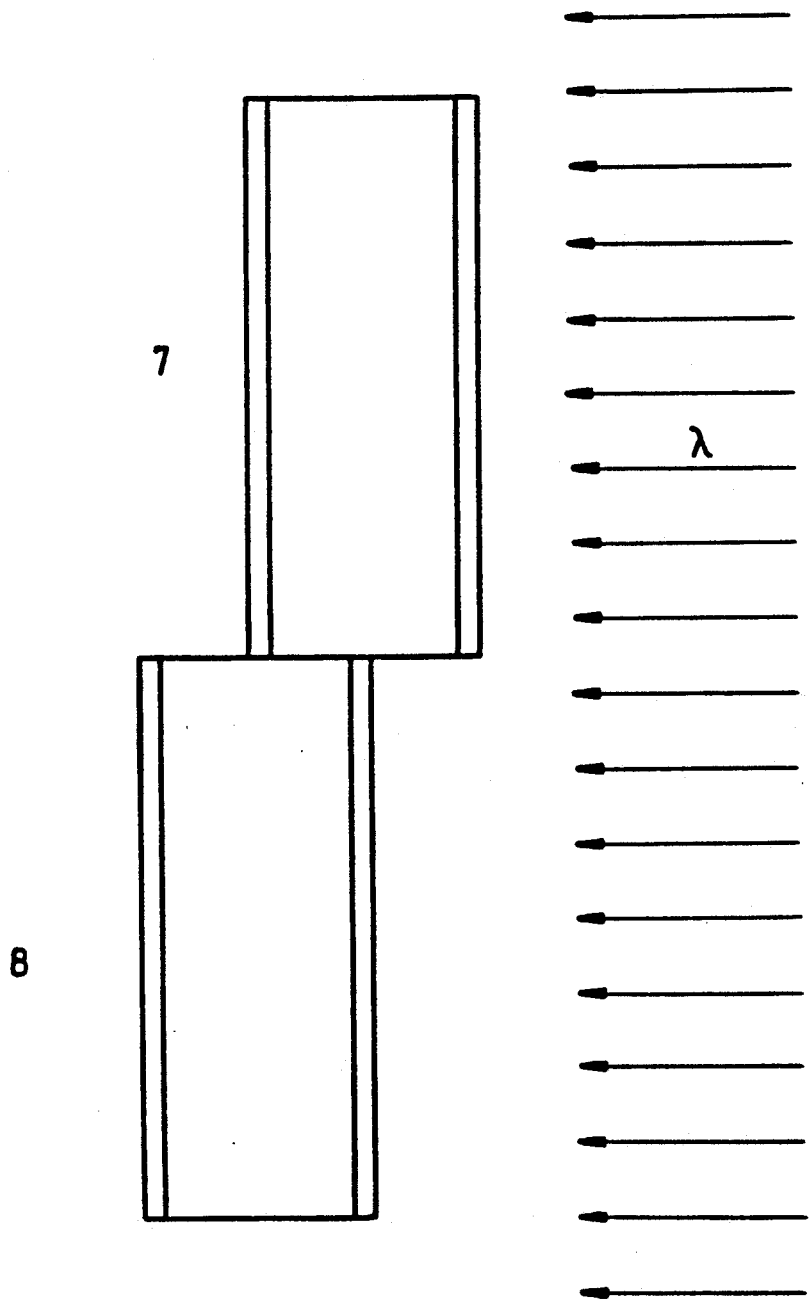
FIG. 4 represents a combination of two semiconductor surfaces.

FIG. 4 represents two semiconductor surfaces 7, 8, each of which is fully identical to the semiconductor surface presented in FIG. 3. Semiconductor surface 7 may produce reflections which are projected in the complex plane along the positive and negative real axes. Semiconductor surface 8 has, however, been shifted over a distance of λ/8 in the propagation direction of the radiation at wavelength λ generated by the radiation source. As a result, reflections at the front and back surfaces of the semiconductor surface 7 will be projected in the complex plane along the positive and negative imaginary axis. This now means that any desired reflection can be produced on the basis of a linear combination, by illuminating the front or back surfaces 7 and the front or back surfaces 8 at light intensities which realise the projections of the desired reflection on the real and imaginary axes.

Figure 5:
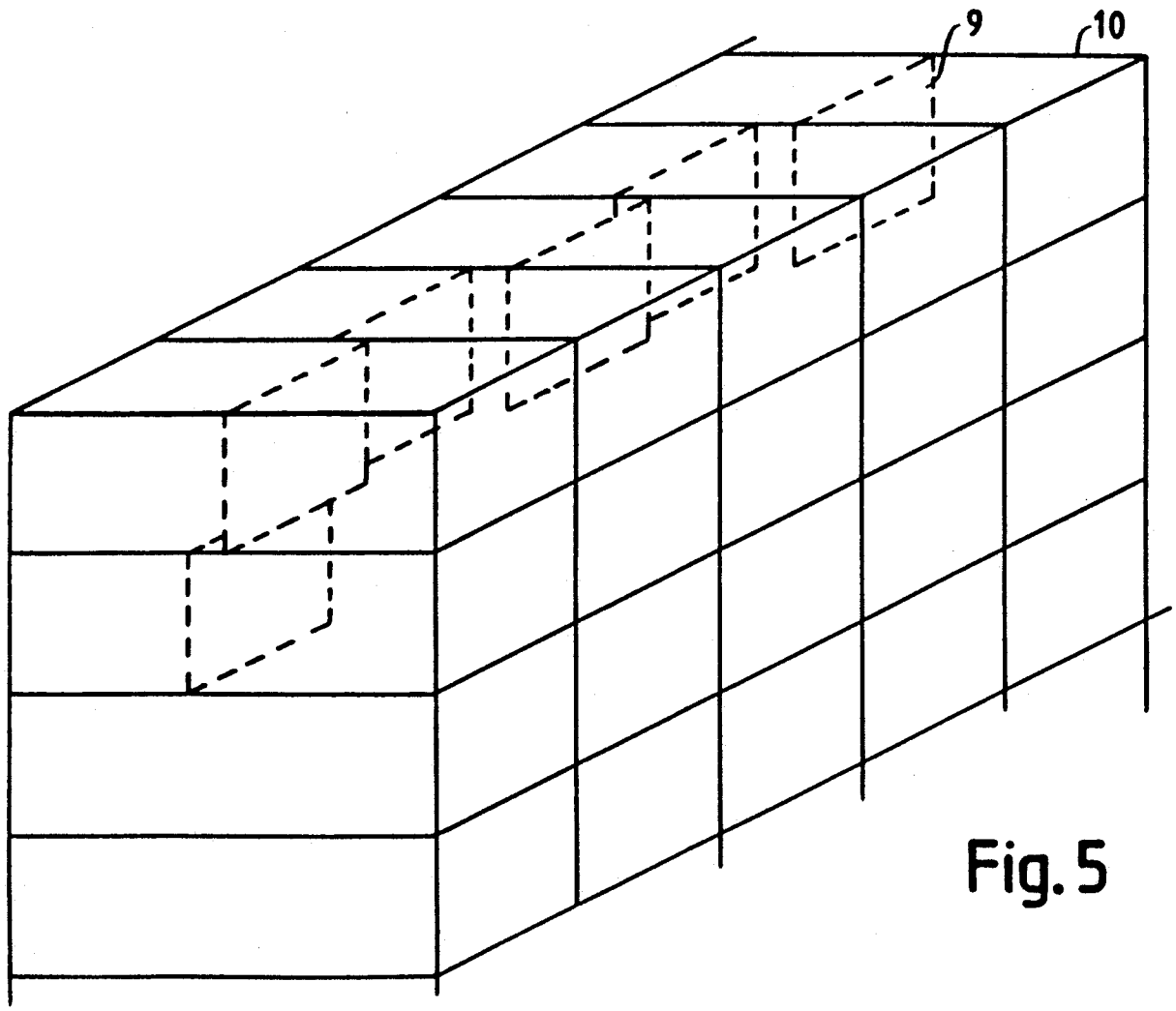
FIG. 5 represents an embodiment of a reflective surface.

A possible embodiment of a reflective surface of an antenna system is represented in FIG. 5. Each semiconductor surface 9, identical with the semiconductor surface shown in FIG. 3, is positioned in a rectangular waveguide 10 having a length of several wavelengths and a side of approximately half a wavelength. A stack of these waveguides, provided with semiconductor surfaces, forms the reflection surface. In order to be able to reflect any desired phase, half of the semiconductor surfaces are shifted λ/8 with respect to the other half, distributed over the reflector surface. So, for instance, those semiconductor surfaces 2.i.j. ($i=1, 2, \ldots, N$; $j=1, 2, \ldots, M$) are shifted for which applies that $i+j$ is even.

Figure 6:
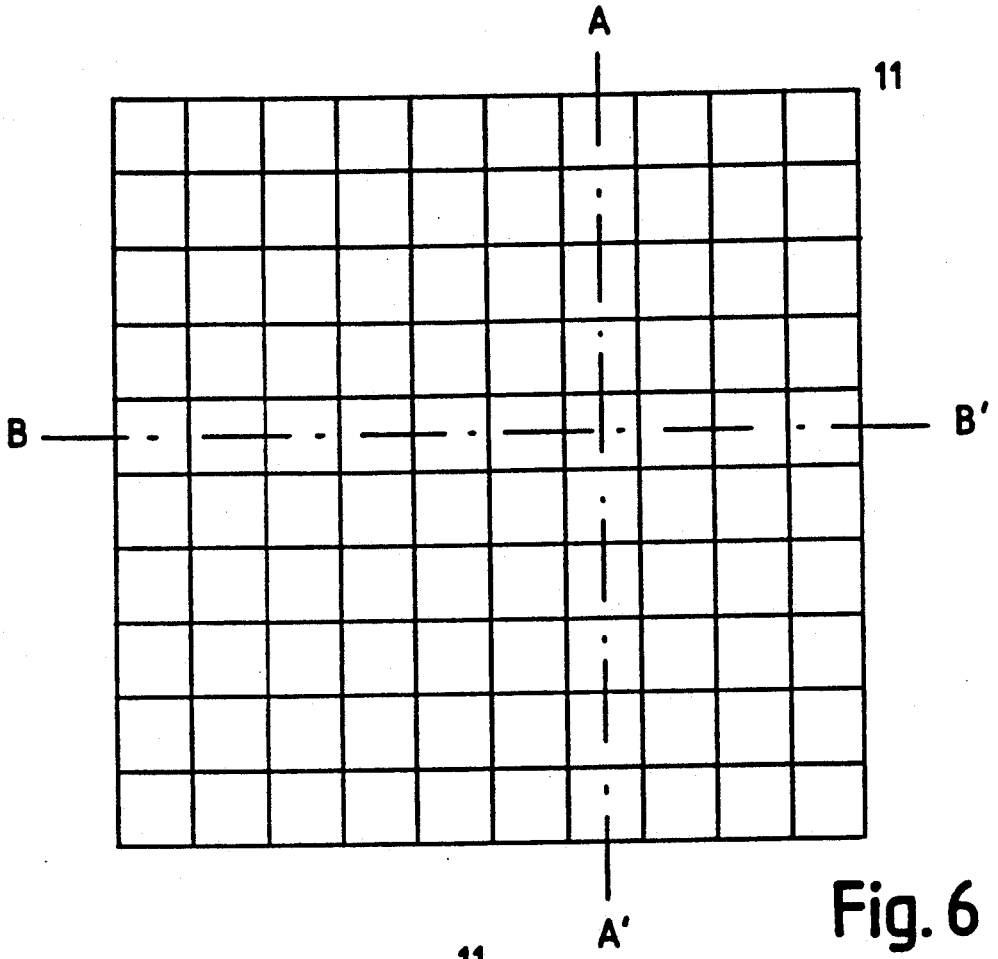
FIG. 6 represents an alternative embodiment of a reflective surface.

An alternative embodiment of the reflective surface is illustrated in FIG. 6. A synthetic foam plate 11 having the dimensions of the reflective surface and a thickness of $\lambda/4+k.\lambda/2$, $k=0, 1, 2, \ldots$, has been produced such that sections 2.i.j ($i=1, 2, \ldots, N$; $j=1, 2, \ldots, M$) are formed in which the sections 2.i.j have been shifted by a distance λ/8, if $i+j$ is even. This is illustrated by the cross-section of the plate along line AA' in FIG. 7. The cross-section along the line BB' is entirely identical. The front and back of each section is covered with a layer of semiconducting material, resulting in a reflective surface which is composed of semiconductor surface identical to those in the descriptions pertaining to FIGS. 3 and 4.

Figure 8:
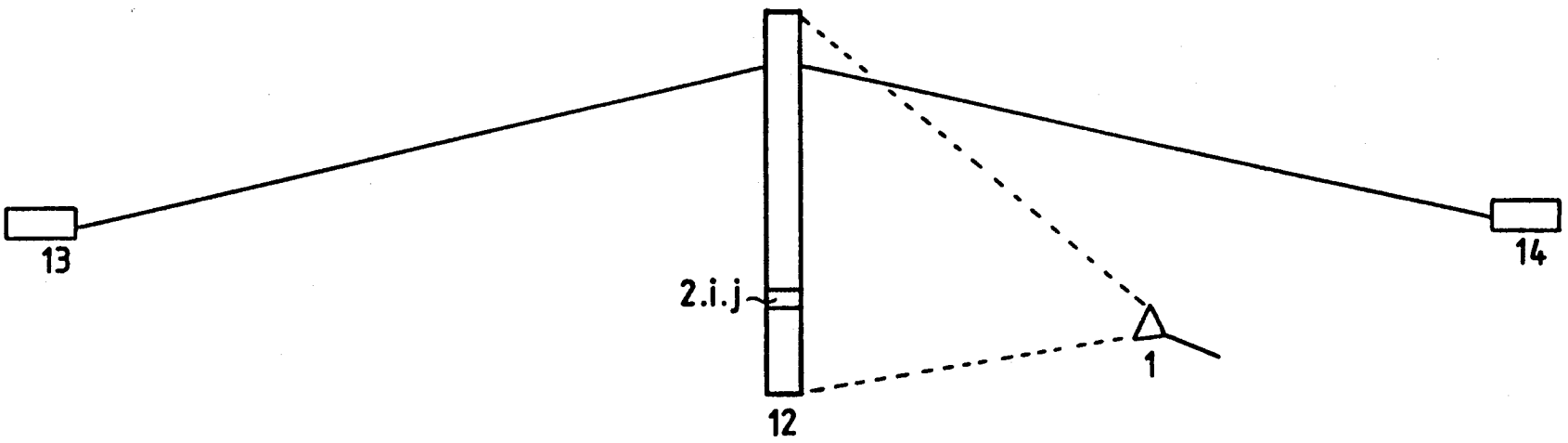
FIG. 8 represents an antenna system with two lasers and deflection means.

FIG. 8 represents an antenna system comprising a feedhorn 1 and a reflective surface 12 according to one of the above descriptions pertaining to FIGS. 5 or 6 and two lasers plus deflection means as light-generating means 13, 14. The reflective surface 12 is provided with N x M semiconductor surfaces 2.i.j ($i=1, 2, \ldots, N$; $j=1, 2, \ldots, M$), half of which have been shifted by a distance λ/8. Adjacent pairs of semiconductor surfaces, one shifted, the other not, form the phase shifters. A computer calculates the reflections at the front and back of both semiconductor surfaces in order to generate a beam with given parameters. Both lasers plus deflection means perform a raster scan across the entire reflective surface comparable to the way in which a TV picure is written. For each semiconductor surface which is illuminated, the intensity of the lasers is adjusted such that the desired reflection is obtained.

A suitable combination for this embodiment is a Nd-Yag laser plus an acousto-optical deflection system, based on Bragg diffraction, well known in the field of laser physics, and semiconductor surfaces with silicon as the semiconducting material. It is essential that a complete raster scan be written in a time period which is shorter than the carrier life time in the silicon used. Consequently, extremely pure silicon shall be used. Since all charges are generated at the surface of the silicon, it is also important that this surface be subjected to a treatment to prevent surface recombination. This treatment is well known in semiconductor technology.

The light-generating means described in FIG. 8 are useful thanks to the memory effect of the semiconducting material, which after illumination continues to contain free charges for a considerable length of time. The drawback is that this results in an inherently slow antenna system. An antenna system with rapidly adjustable beam parameters can be obtained by using a different semiconducting material, for instance less pure silicon with a shorter carrier life time. In that case it is necessary that the lasers plus deflection means write the grid faster on the NxM semiconductor surfaces. The limited speed of the deflection system will then become a factor, forming an obstacle to a proper functioning system. A solution is that for each row or column a laser plus a one-dimensional deflection system is introduced which is modulated in amplitude in an analog way. Instead of two lasers, 2N or 2M lasers will then be required.

Figure 9:
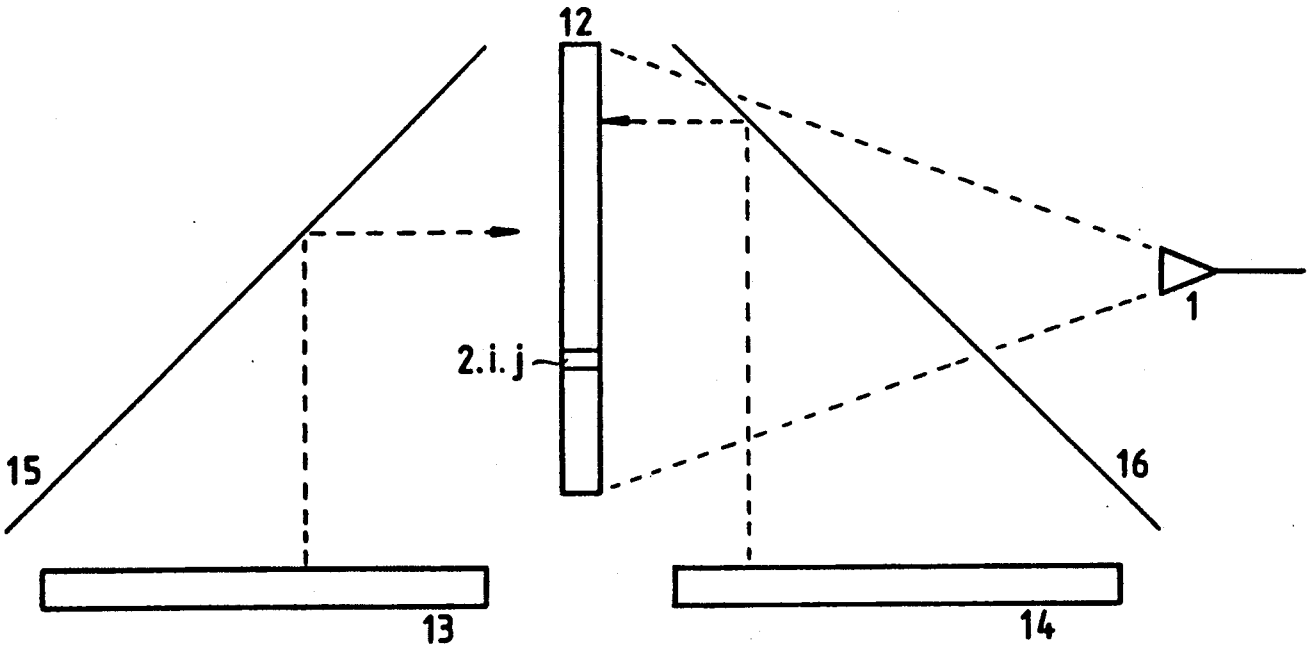
FIG. 9 represents an antenna system with two laser arrays, each equipped with NxM lasers.

An antenna system with very fast adjustable beams is illustrated in FIG. 9. The reflective surface 12 is illuminated by feedhorn 1 straight through a surface 16 which is transparent to the radiation generated by the radiation source, but is a good reflector for laser beams. This could be a dielectric mirror. The light-generating means 13, 14 consist of two arrays, each of NxM lasers. Thus, each semiconductor surface 2.i.j ($i=1, 2, \ldots, N$; $j=1, 2, \ldots, M$) is illuminated by two lasers; one from light-generating means 13 via dielectric mirror 15 and one from light-generating means 14 via dielectric mirror 16. The reflection at one semiconductor surface 2.i.j. can now be adjusted by controlling the intensity of the associated two lasers.

As the semiconductor material for this embodiment, silicon can be used which, owing to impurity, may have a virtually arbitrarily short life time and consequently results in an arbitrarily fast adjustable antenna system. The lasers can be semiconductor lasers having a wavelength of approximately 1 $\mu$m.

It is also possible to illuminate the reflective surface as illustrated in FIG. 5 with light-emitting diodes or lasers such that in each waveguide, on either side of the semiconductor surface, at least one light-emitting diode or laser is fitted to illuminate the semiconductor surface. The light-emitting diodes or lasers can also be fitted outside the waveguide, in which case the light is passed to the associated semiconductor surfaces via fiber optics.

Figure 7:
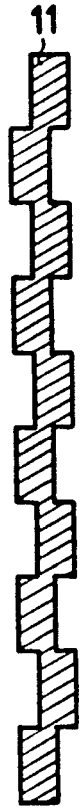
FIG. 7 represents a cross-section along the line AA' in FIG. 6.

In the embodiments shown, two thin layers of semiconducting material were used. It is possible, however, to use three or more thin layers. The advantage is that the shifting between adjacent semiconductor surfaces 9, as shown in FIGS. 5, 6, 7 is not necessary.

Figure 10:
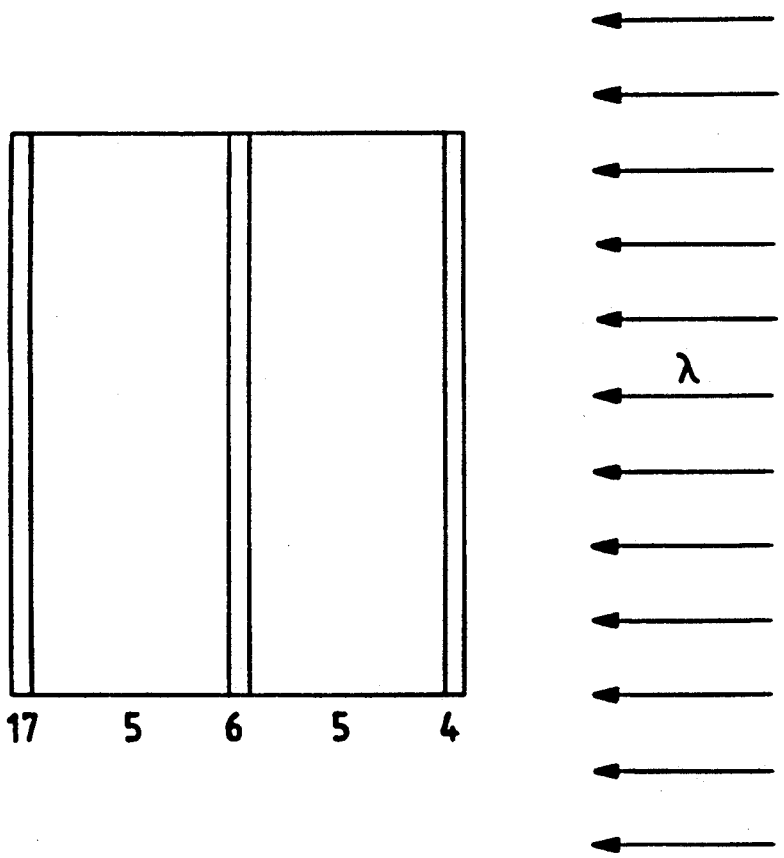
FIG. 10 represents a cross-section of an alternative semiconductor surface.

In FIG. 10 an embodiment of a semiconductor surface is shown with three thin semiconducting layers 4, 6, 17 and two spacers 5. The spacers 5 have a length of $\lambda/6+k.\lambda/2$, $k=0, 1, 2, \ldots$ This means that reflections from the layers 4, 6, 17 will be projected in the complex plane in the directions exp (0), exp ($\frac{2}{3}\pi i$), exp ($4/3\ \pi i$). Any reflection can be produced now on the basis of linear combinations by illuminating the layers 4, 6, 17, each with their own light-generating means.

It is necessary however to illuminate the layer 6 through one of the layers 4 or 17. This can be done by using different types of semiconducting material.

In a possible embodiment silicon is used for the layers 4 and 17, while germanium is used for the layer 6. Light-generating means cooperating with the layers 4 and 17 are matched to the band gap of silicon (1.21 eV). Light-generating means cooperating with layer 6 are matched to the band gap of germanium (0.78 eV). Light of the latter type will produce free carriers in germanium, while silicon is transparent to it.

I claim:

1. An antenna system comprising: at least one active radiation source and a radiation reflective surface which is positioned in at least a part of the path of the radiation generated by the active radiation source, wherein the reflective surface comprises semiconductor surfaces, light-generating means arranged to illuminate the semiconductor surfaces with light such that, after reflection at the reflecting semiconductor surfaces of the radiation generated by the active radiation source, at least one radiation beam is obtained, said light-generating means being energized so as to vary the light intensity in a manner so as to adjust the reflection coefficient of at least one of said semiconductor surfaces thereby to adjust beam width and/or beam direction of said reflected radiation beam.

2. An antenna system as claimed in claim 1, wherein the reflective surface comprises a number of substantially contiguous semiconductor surfaces.

3. An antenna system as claimed in claim 1, wherein the reflective surface includes waveguides with the semiconductor surfaces fitted in the waveguides.

4. An antenna system as claimed in claim 2, wherein substantially a first half of the semiconductor surfaces are positioned in a first plane and the remaining semiconductor surfaces are positioned in a second plane and the distance between the first and the second plane is $\lambda/8+k.\lambda/2$, $k=0, 1, 2, \ldots$, $\lambda$ being the wavelength of the radiation generated by the radiation source and reflected at the semiconductor surfaces.

5. An antenna system as claimed in claim 1 or 4 wherein a semiconductor surface includes two layers of semiconducting material and a spacer therebetween.

6. An antenna system as claimed in claim 5, wherein the distance between the two layers of semiconducting material is $\lambda/4+k.\lambda/2$, $k=0, 1, 2, \ldots$, $\lambda$ being the wavelength of the radiation generated by the radiation source.

7. An antenna system as claimed in claim 1 wherein the semiconducting material of a semiconductor surface is silicon.

8. An antenna system as claimed in any one of claims 1–3, wherein a semiconductor surface comprises three layers of semiconducting material and with first and second spacers alternately positioned therebetween.

9. An antenna system as claimed in claim 8, wherein the distance between two successive layers of semiconducting material is $\lambda/6+k.\lambda/2$, $k=0, 1, 2, \ldots$, $\lambda$ being the wavelength of the radiation generated by the radiation source.

10. An antenna system as claimed in claim 1 wherein the semiconducting material of a semiconductor surface includes an anti-reflection coating for the light from the means for generating light.

11. An antenna system as claimed in claim 1 wherein the light-generating means comprise at least one laser.

12. An antenna system as claimed in claim 11, wherein the laser is a Nd-Yag laser.

13. An antenna system as claimed in claim 11, wherein the laser is a semiconductor laser.

14. An antenna system as claimed in claim 1 wherein the light-generating means comprise at least one light-emitting diode.

15. An antenna system as claimed in claim 1 wherein the light from the light-generating means is passed to the semiconductor surfaces via fiber optics.

16. An antenna system as claimed in anyone of claims 1–4 wherein the radiation generated by the active radiation source comprises microwave energy.

17. An antenna system as claimed in anyone of claims 1–4 wherein the light-generating means only generate infrared radiation.

18. A radar apparatus comprising: an antenna system as claimed in claim 1, and a computer which controls the light-generating means such that the reflections at the semiconductor surfaces of at least a part of the radiation generated by the active radiation source produces at least one radar beam with adjustable beam direction and adjustable beam width.

19. An antenna beam forming system comprising:

a radiation reflective surface which comprises at least first and second surfaces of semiconductor material separated by a spacer, a source of electromagnetic radiation for directing electromagnetic radiation at said radiation reflective surface, means for generating a light beam which is arranged to illuminate the first and second semiconductor surfaces, said light beam generating means being energized so as to vary the intensity of the light beam illuminating the semiconductor surfaces in a pattern arranged to adjust the reflection coefficient thereof such that the semiconductor surfaces reflect the electromagnetic radiation received so as to produce an electromagnetic radiation beam having a beam width and/or beam direction adjustable as a function of said light beam pattern.

20. An antenna system as claimed in claim 19 wherein the spacer separates the first and second semiconductor surfaces by a distance of $\lambda/4+k\lambda/2$, where $k=0, 1, 2 \ldots$ and $\lambda$ is the wavelength of the electromagnetic radiation generated by said electromagnetic radiation source and is also the wavelength of the electromagnetic radiation reflected by the radiation reflective surface.

21. An antenna system as claimed in claim 19 wherein said light beam generating means comprises first and second lasers arranged to illuminate the first and second semiconductor surfaces, respectively, means for deflecting respective light beams of said first and second lasers in a raster scan across the respective first and second semiconductor surfaces, and means for modulating the intensity of the respective light beams so as to obtain said electromagnetic radiation beam with adjustable beam width and/or beam direction.

* * * * *